US005809930A

United States Patent [19]

Brooks

[11] Patent Number: 5,809,930

[45] Date of Patent: Sep. 22, 1998

[54] FLAGPOLE ROTATION DEVICE

[76] Inventor: Joseph Carl Brooks, 9522 S. 89th E. Ave., Tulsa, Okla. 74133

[21] Appl. No.: 796,635

[22] Filed: Feb. 7, 1997

[51] Int. Cl.[6] ..... G09F 17/00

[52] U.S. Cl. ..... 116/174; 116/173; 40/601

[58] Field of Search ..... 116/173, 174, 116/175; 40/601, 607

[56] References Cited

U.S. PATENT DOCUMENTS

| | | | |
|---|---|---|---|
| 689,077 | 12/1901 | Griffith | 116/174 |
| 957,606 | 5/1910 | Hendricks et al. | 116/174 |
| 1,048,291 | 12/1912 | Buckley | 116/174 |
| 1,148,362 | 7/1915 | Dahlberg | 116/174 |
| 1,306,915 | 6/1919 | Klamroth | 116/174 |
| 1,311,712 | 7/1919 | Power | 116/174 |
| 1,554,758 | 9/1925 | Post | 116/174 |
| 2,672,118 | 3/1954 | Martin | 116/174 |
| 3,595,202 | 7/1971 | Visitacion | 116/174 |
| 5,383,420 | 1/1995 | Dundorf | 116/174 |
| 5,634,619 | 6/1997 | Alessi | 248/219.3 |

FOREIGN PATENT DOCUMENTS

| | | | |
|---|---|---|---|
| 454606 | 1/1928 | Germany | 116/174 |

*Primary Examiner*—Diego F. F. Gutierrez
*Assistant Examiner*—Andrew Hirshfeld

[57] ABSTRACT

A flagpole rotation device comprised of an upper collar having two U-shaped portions. The two U-shaped portions are adapted for securement around a flag pole. The two U-shaped portions are tightly secured around the flagpole. The device contains a rotator portion having two U-shaped portions. The two U-shaped portions have inner nylon surfaces. The two U-shaped portions are adapted for securement around the flag pole. The two U-shaped portions are loosely secured around the flagpole. The rotator is disposed on the flagpole beneath the upper collar. The device contains a lower collar having two U-shaped portions. The two U-shaped portions are adapted for securement around a flag pole. The two U-shaped portions are tightly secured around the flagpole. The lower collar is disposed on the flagpole beneath the rotator. A tie-off cleat is secured to the outer surface of the rotator portion. The tie-off cleat serves for securement to a lanyard attached to a flag.

1 Claim, 7 Drawing Sheets

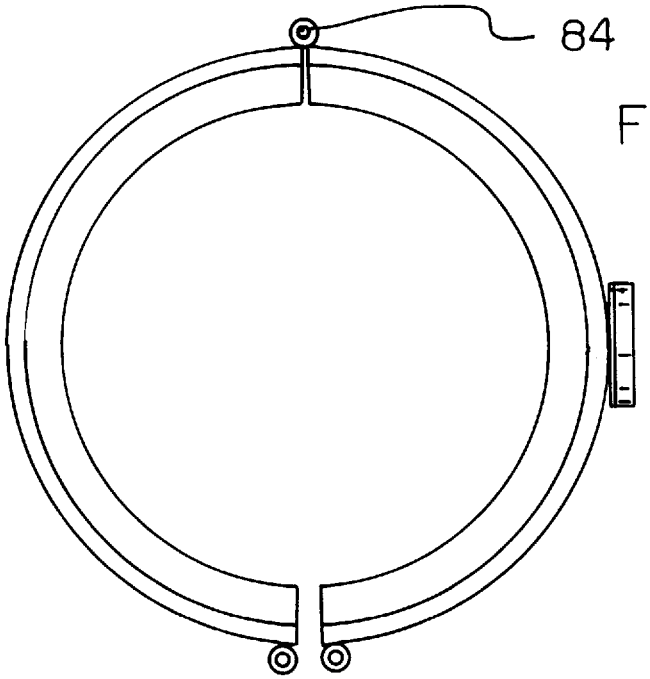
FIG 9
FIG 10
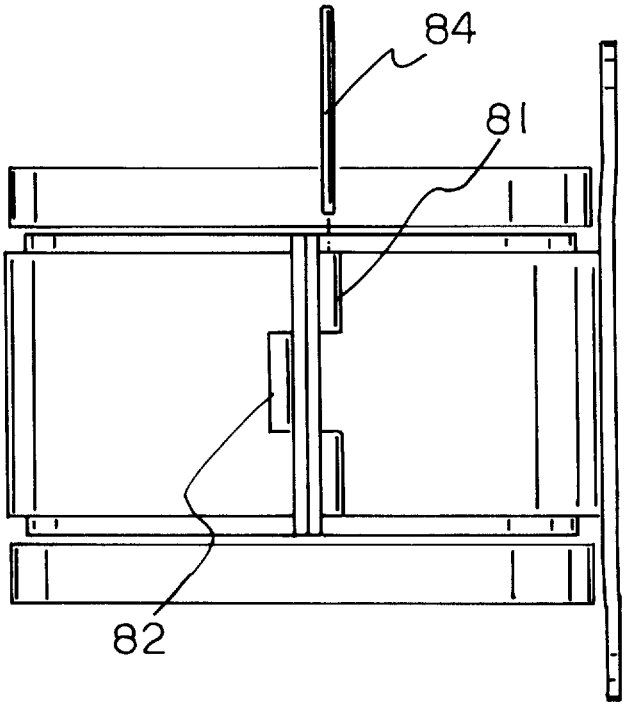

FIG 11
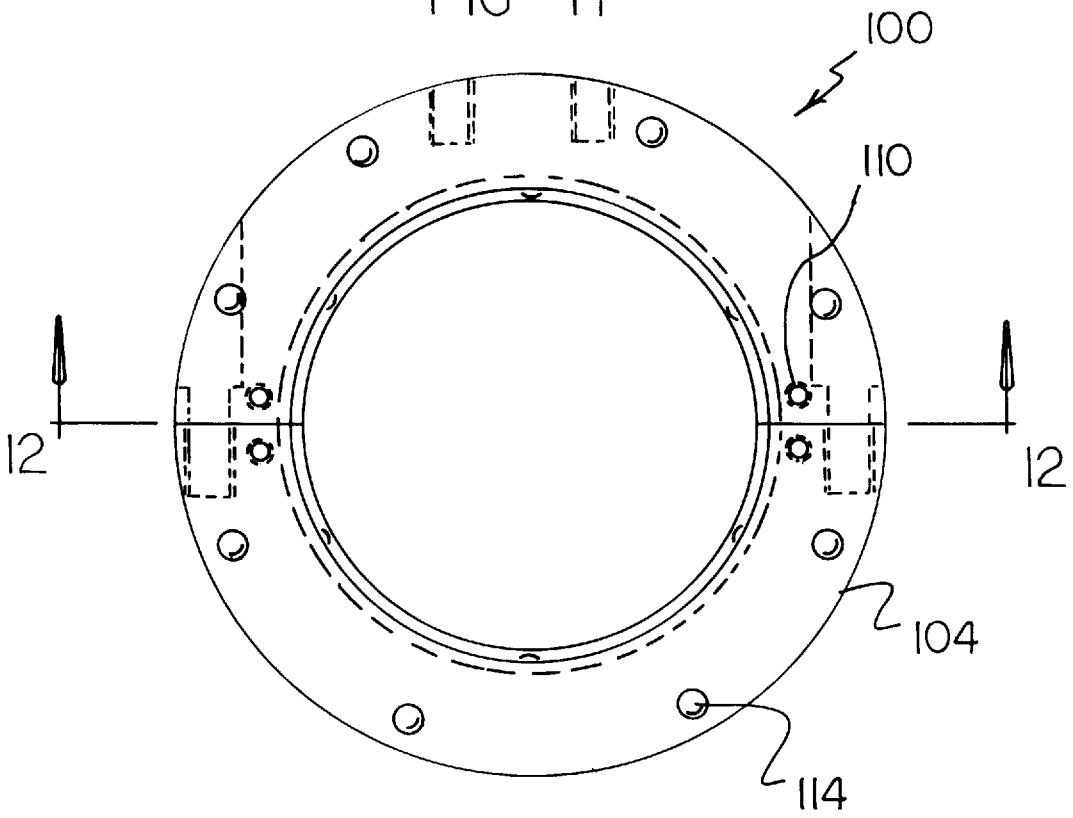
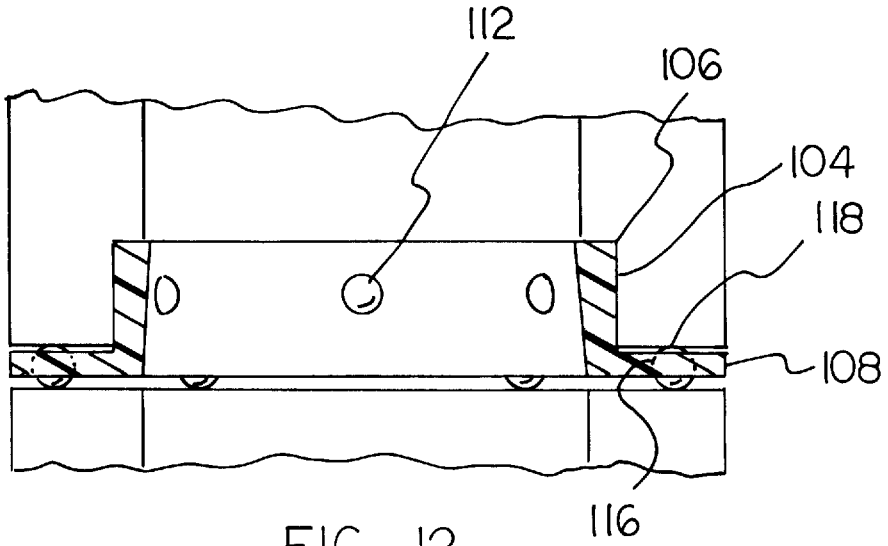
FIG 12

FLAGPOLE ROTATION DEVICE

BACKGROUND OF THE INVENTION

1. Field of the Invention

The present invention relates to a flagpole rotation device and more particularly pertains to allowing a flag to freely rotate around a flagpole following the wind direction with a flagpole rotation device.

2. Description of the Prior Art

The use of flag unfurlers is known in the prior art. More specifically, flag unfurlers heretofore devised and utilized for the purpose of maintaining a flag in an unfurled state are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 345,947 to Brown et al. discloses the ornamental design for a flag pole.

U.S. Pat. No. 5,279,250 to Palermo, Jr. et al discloses an automatic flag unfurler.

U.S. Pat. No. 5,291,849 to Zeitler discloses a flag support with furl preventer.

U.S. Pat. No. 5,044,301 to Peters et al. discloses an automatic flag unfurler.

U.S. Pat. No. 3,820,500 to Merryweather discloses a flag pole combination.

While these devices fulfill their respective, particular objective and requirements, the aforementioned patents do not describe a flagpole rotation device for allowing a flag to freely rotate around a flagpole following the wind direction.

In this respect, the flagpole rotation device according to the present invention substantially departs from the conventional concepts and designs of the prior art, and in doing so provides an apparatus primarily developed for the purpose of allowing a flag to freely rotate around a flagpole following the wind direction.

Therefore, it can be appreciated that there exists a continuing need for new and improved flagpole rotation device which can be used for allowing a flag to freely rotate around a flagpole following the wind direction. In this regard, the present invention substantially fulfills this need.

SUMMARY OF THE INVENTION

In the view of the foregoing disadvantages inherent in the known types of flag unfurler now present in the prior art, the present invention provides an improved flagpole rotation device. As such, the general purpose of the present invention, which will be described subsequently in greater detail, is to provide a new and improved flagpole rotation device and method which has all the advantages of the prior art and none of the disadvantages.

To attain this, the present invention essentially comprises an upper collar having a first U-shaped portion and a second U-shaped portion. The first U-shaped portion has threaded apertures formed through end portions thereof. The second U-shaped portion has threaded apertures formed through end portions thereof. The first U-shaped portion and the second U-shaped portion are adapted for securement around a flag pole. The first U-shaped portion is tightly secured to the second U-shaped portion around the flagpole by a pair of bolts through the respective threaded apertures thereof. The device contains a rotator portion having a first U-shaped portion and a second U-shaped portion. The first U-shaped portion has an inner nylon surface. The first U-shaped portion has a pair of vertically aligned threaded apertures formed through end portions thereof. The first U-shaped portion has a securement bracket secured to an outer surface thereof. The second U-shaped portion has an inner nylon surface. The second U-shaped portion has a pair of vertically aligned threaded apertures formed through end portions thereof. The first U-shaped portion and the second U-shaped portion are adapted for securement around the flag pole. The first U-shaped portion is loosely secured to the second U-shaped portion around the flagpole by bolts through the respective pair of vertically aligned threaded apertures thereof. The rotator is disposed on the flagpole beneath the upper collar. The device contains a lower collar having a first U-shaped portion and a second U-shaped portion. The first U-shaped portion has threaded apertures formed through end portions thereof. The second U-shaped portion has threaded apertures formed through end portions thereof. The first U-shaped portion and the second U-shaped portion are adapted for securement around a flag pole. The first U-shaped portion is tightly secured to the second U-shaped portion around the flagpole by a pair of bolts through the respective threaded apertures thereof. The lower collar is disposed on the flagpole beneath the rotator. A tie-off cleat is secured to the securement bracket of the outer surface of the first U-shaped portion of the rotator portion. The tie-off cleat serves for securement to a lanyard attached to a flag.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved flagpole rotation device which has all the advantages of the prior art flag unfurler and none of the disadvantages.

It is another object of the present invention to provide a new and improved flagpole rotation device which may be easily and efficiently manufactured and marketed.

It is a further object of the present invention to provide a new and improved flagpole rotation device which is of durable and reliable construction.

An even further object of the present invention is to provide a new and improved flagpole rotation device which is susceptible of a low cost of manufacture with regard to both materials and labor, and which accordingly is then susceptible of low prices of sale to the consuming public, thereby making such a flagpole rotation device economically available to the buying public.

Still yet another object of the present invention is to provide a new and improved flagpole rotation device which provides in the apparatuses and methods of the prior art some of the advantages thereof, while simultaneously overcoming some of the disadvantages normally associated therewith.

Even still another object of the present invention is to provide a new and improved flagpole rotation device for allowing a flag to freely rotate around a flagpole following the wind direction.

Lastly, it is an object of the present invention to provide a new and improved flagpole rotation device comprised of an upper collar having two U-shaped portions. The two U-shaped portions are adapted for securement around a flag pole. The two U-shaped portions are tightly secured around the flagpole. The device contains a rotator portion having two U-shaped portions. The two U-shaped portions have inner nylon surfaces. The two U-shaped portions are adapted for securement around the flag pole. The two U-shaped portions are loosely secured around the flagpole. The rotator is disposed on the flagpole beneath the upper collar. The device contains a lower collar having two U-shaped portions. The two U-shaped portions are adapted for securement around a flag pole. The two U-shaped portions are tightly secured around the flagpole. The lower collar is disposed on the flagpole beneath the rotator. A tie-off cleat is secured to the outer surface of the rotator portion. The tie-off cleat serves for securement to a lanyard attached to a flag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a top view of another alternate embodiment of the present invention.

FIG. 10 is side view of the alternate embodiment shown in FIG. 7.

FIG. 11 is a top plan view of yet another alternate embodiment of the present invention.

FIG. 12 is a side view of the nylon bushing of the alternate embodiment shown in FIG. 11.

The same reference numerals refer to the same parts through the various Figures.

DESCRIPTION OF THE PREFERRED EMBODIMENT

Figure 1:
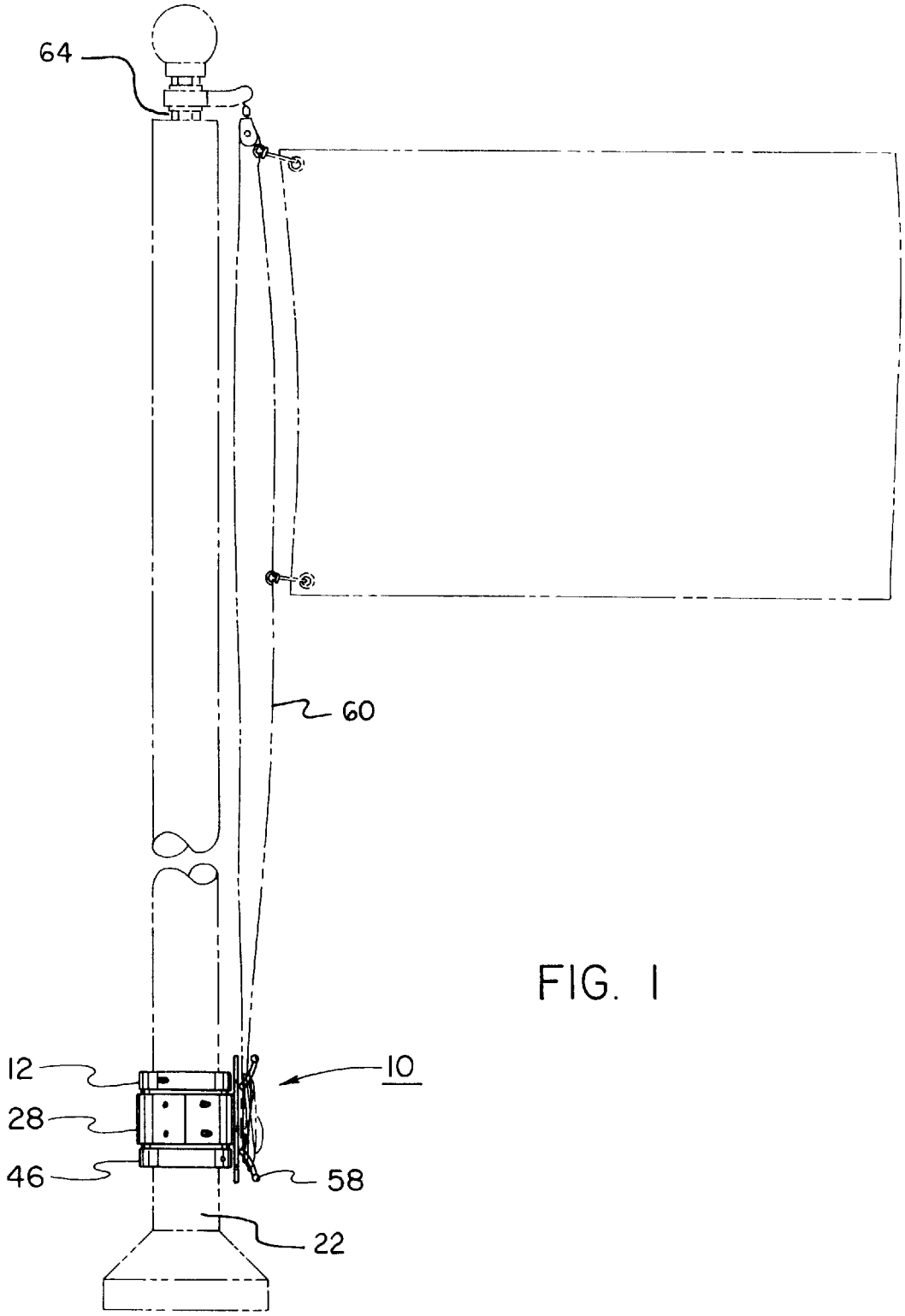
FIG. 1 is a side view of the preferred embodiment of the flagpole rotation device constructed in accordance with the principles of the present invention.
Figure 2:
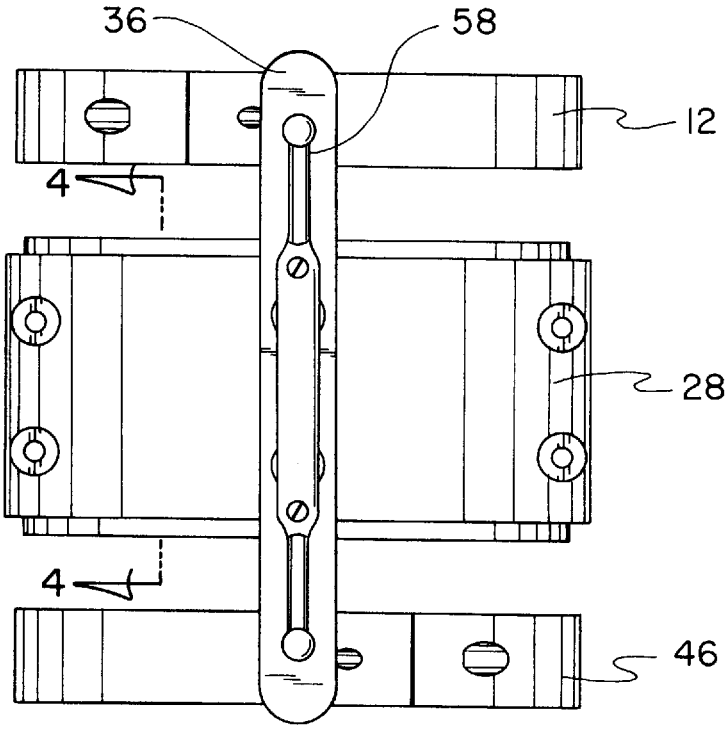
FIG. 2 is a front elevation view of the present invention.
Figure 3:
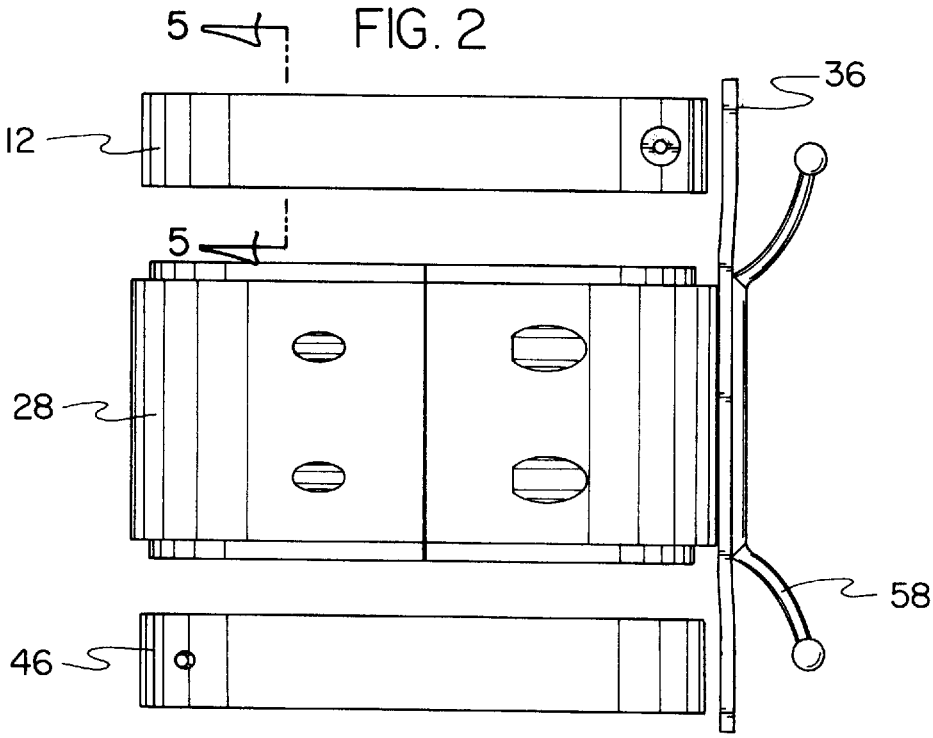
FIG. 3 is a side elevation view of the present invention.
Figure 4:
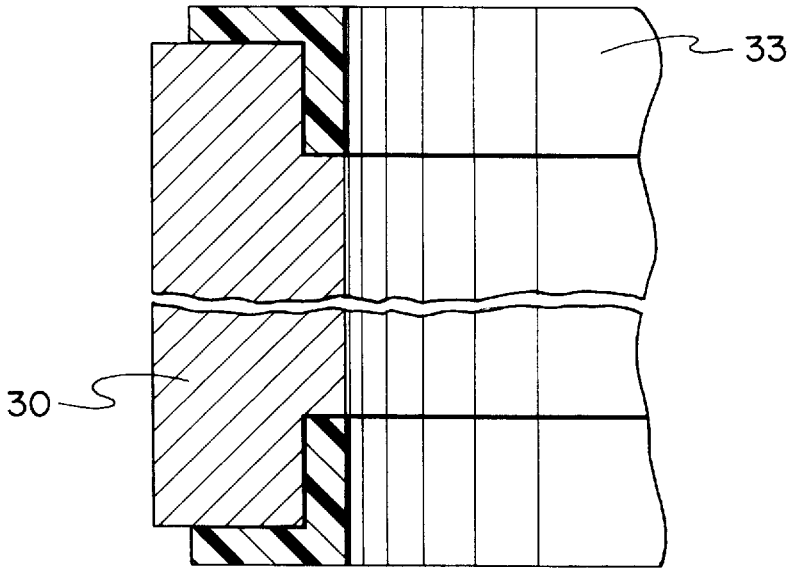
FIG. 4 is a cross-sectional view as taken along line 4—4 of FIG. 2.
Figure 5:
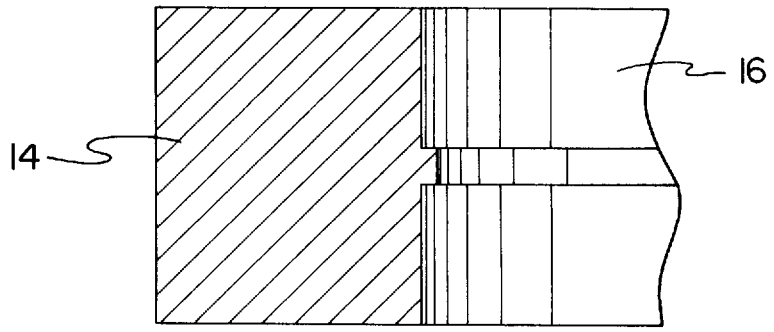
FIG. 5 is a cross-sectional view as taken along line 5—5 of FIG. 3.
Figure 6:
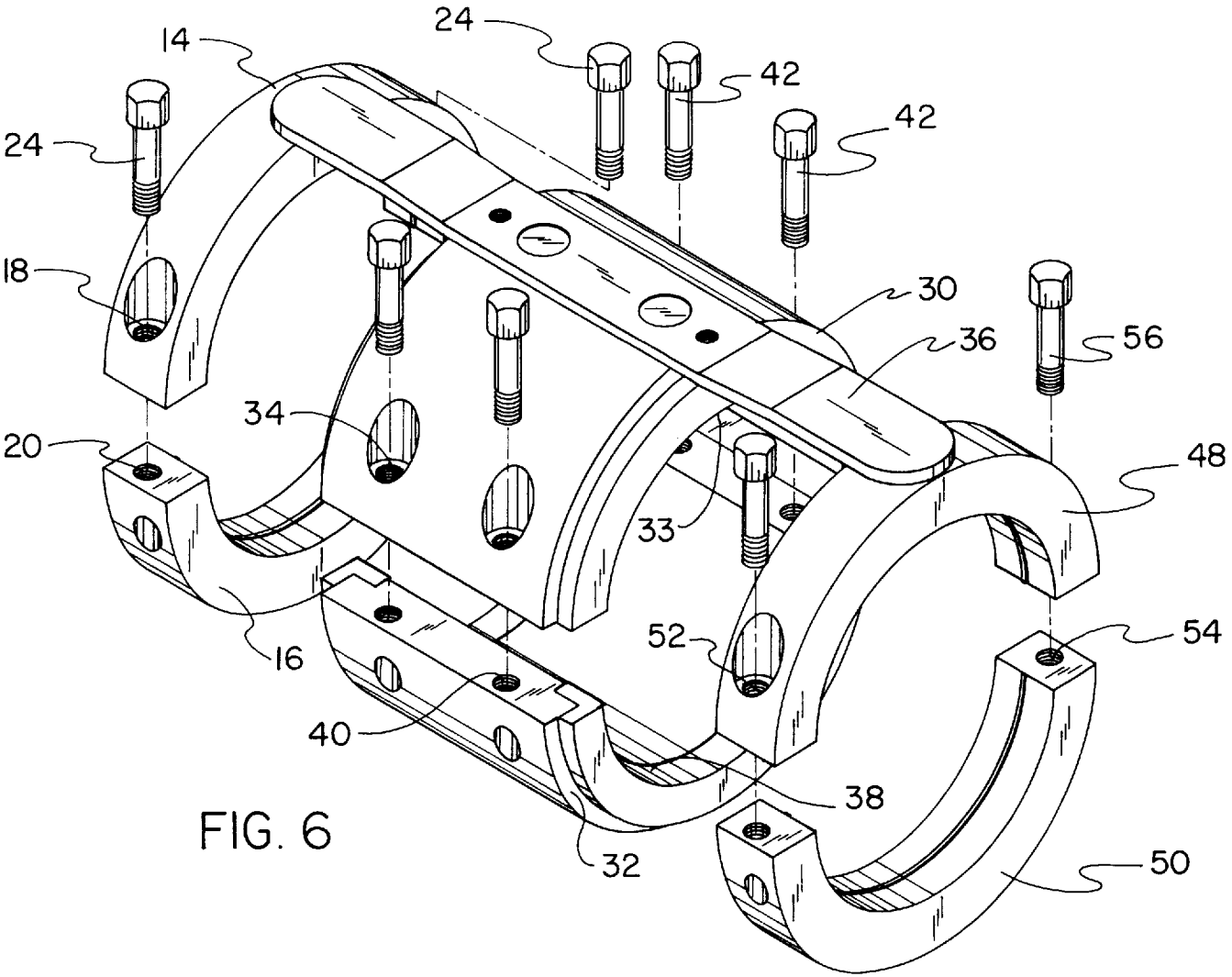
FIG. 6 is an exploded perspective view of the present invention.

With reference now to the drawings, and in particular, to FIG. 1 thereof, the preferred embodiment of the new and improved flagpole rotation device embodying the principles and concepts of the present invention and generally designated by the reference number 10 will be described.

Specifically, it will be noted in the various Figures that the device relates to a new and improved flagpole rotation device for allowing a flag to freely rotate around a flagpole following the wind direction. In its broadest context, the device consists of an upper collar, a rotator portion, a lower collar, and a tie-off cleat.

The device 10 contains an upper collar 12 having a first U-shaped portion 14 and a second U-shaped portion 16. The first U-shaped portion 14 has threaded apertures 18 formed through end portions thereof. The second U-shaped portion 16 has threaded apertures 20 formed through end portions thereof. The first U-shaped portion 14 and the second U-shaped portion 16 are adapted for securement around a flag pole 22. The first U-shaped portion 14 is tightly secured to the second U-shaped portion 16 around the flagpole 22 by a pair of bolts 24 through the respective threaded apertures 18,20 thereof.

The device 10 contains a rotator portion 28 having a first U-shaped portion 30 and a second U-shaped portion 32. The first U-shaped portion 30 has an inner nylon surface 33. The first U-shaped portion 30 has a pair of vertically aligned threaded apertures 34 formed through end portions thereof. The first U-shaped portion 30 has a securement bracket 36 secured to an outer surface thereof. The second U-shaped portion 32 has an inner nylon surface 38. The second U-shaped portion 32 has a pair of vertically aligned threaded apertures 40 formed through end portions thereof. The first U-shaped portion 30 and the second U-shaped portion 32 are adapted for securement around the flag pole 22. The first U-shaped portion 30 is loosely secured to the second U-shaped portion 32 around the flagpole 22 by bolts 42 through the respective pair of vertically aligned threaded apertures 34,40 thereof. The rotator portion 28 is disposed on the flagpole 22 beneath the upper collar 12.

The device 10 contains a lower collar 46 having a first U-shaped portion 48 and a second U-shaped portion 50. The first U-shaped portion 48 has threaded apertures 52 formed through end portions thereof. The second U-shaped portion 50 has threaded apertures 54 formed through end portions thereof. The first U-shaped portion 48 and the second U-shaped portion 50 are adapted for securement around the flag pole 22. The first U-shaped portion 48 is tightly secured to the second U-shaped portion 50 around the flagpole 22 by a pair of bolts 56 through the respective threaded apertures 52,54 thereof. The lower collar 46 is disposed on the flagpole 22 beneath the rotator 28.

A tie-off cleat 58 is secured to the securement bracket 36 of the outer surface of the first U-shaped portion 30 of the rotator portion 28. The tie-off cleat 58 serves for securement to a lanyard 60 attached to a flag 62.

This device 10 allows a flag 62 to rotate around a flagpole 22 following the wind direction without the flag 62 becoming twisted or tangled.

Three pieces attach to the flagpole 22 at the spot where a lower tie-off cleat was previously located: an upper collar 12, a lower collar 46, and a central sleeve called a rotator 28. The upper collar 12 is a short, split aluminum cylinder placed around the flagpole 22 and then tightened securely with two bolts 24. The lower collar 46 is exactly like the upper collar 12. Between the two collars 12, 46 is the rotator 28: a split aluminum sleeve lined with nylon to reduce friction between the flagpole 22 and the rotator 28. It is split and secured only loosely around the pole with bolts 42 to allow free rotation. A new lower tie-off cleat 58 is mounted on the rotator 28.

When the flag 62 is raised and the lanyard 60 is attached to the tie-off cleat 58 on the rotator portion 28, the flag 22 is attached to the rotator 28 and an upper rotating mechanism (standard on flagpoles) 64, but not to a fixed position on the flagpole 22. When the wind changes direction, the flag 62 rotates around the top of the flagpole 22 and pulls on the lanyard 60. Since the lanyard 60 is fixed to the cleat 58 on the rotator 28, the rotator 28 spins freely, following the wind direction.

Flags 62 can be flown in any weather without fear of tangling or twisting. It is no longer necessary for a person to take the time to untangle the lanyard 60 and flag 62 after it has become twisted.

Figure 7:
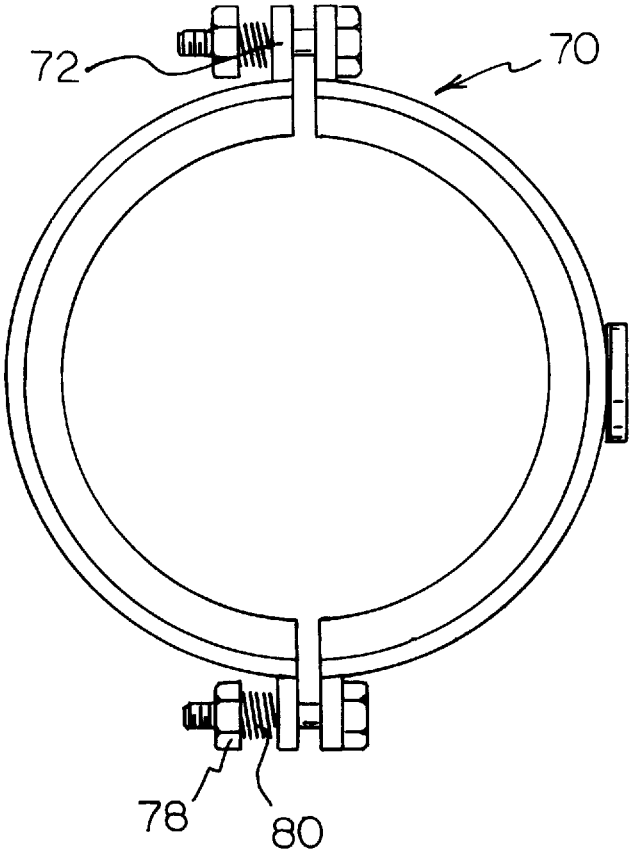
FIG. 7 is a top view of an alternate embodiment of the present invention.
Figure 8:
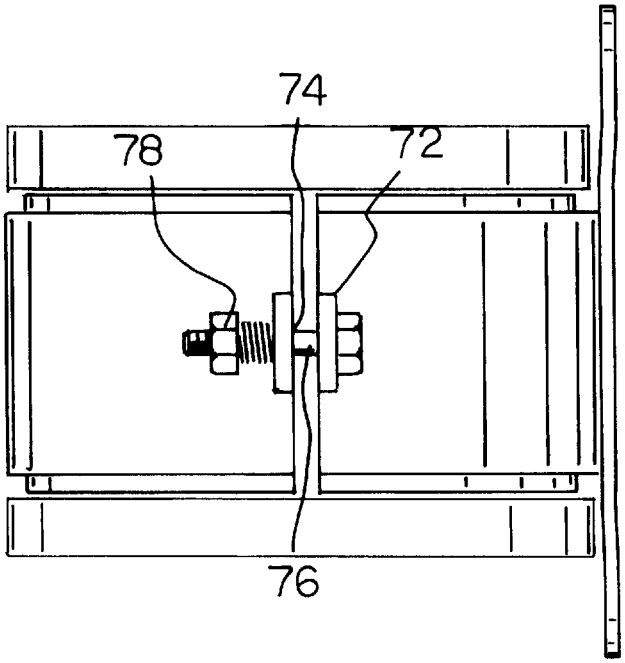
FIG. 8 is side view of the alternate embodiment shown in FIG. 7.

In an alternate embodiment 70 as shown in FIGS. 7 & 8, the U-shaped portions of the rotator portion each have tabs 72 extending radially outward from a central extent of the ends thereof. Each tab has a bore 74 formed therein such that upon the situation of the U-shaped portion in operative alignment, the bores are aligned. The device further includes a pair of bolts 76 each adapted to be slidably situated within the bores of the corresponding tabs. A pair of nuts 78 are included for screwably coupling with the bolts. Lastly, a pair of springs 80 are each situated about a corresponding bolt between the associated nut and tab. Ideally, a majority of the screw adjacent a head thereof is formed without threads so as to afford a smooth surface on which the tabs and spring may slide freely. By this structure, the force exerted by the rotator portion on the flagpole allows ideal slidable abutment of the nylon surface on the flag pole. It should be noted that the nuts may be adjusted to pre-tension the spring thereby allowing a user to determine the force exerted by the rotator on the flag pole.

In another alternate embodiment as shown in FIGS. 9 & 10, a first end of a first U-shaped portion of the rotator portion has a sleeve 81 formed thereon along the entire length thereof with the exception of a central extent thereof. In addition, a first end of a second U-shaped portion of the rotator portion has a sleeve 82 formed therein at a central extent thereof. As such, the sleeves are axially aligned and a pin 84 is positioned therein for allowing the U-shaped portions to pivot with respect to each other thereby affording convenient installation thereof on to the flag pole. Preferably, a sleeve of one of the U-shaped portions is of a slightly reduced diameter to prevent the pin from being removed by means of gravity. To secure the rotator portion to a flag pole, a second end of the first U-shaped portion and a second end of the second U-shaped portion of the rotator portion are secured via a bolt.

Another alternate embodiment 100 of the present invention is shown in FIGS. 11 & 12. In the present embodiment, the inner nylon surfaces of the previous embodiments include a removable upper annular nylon bushing and a removable lower annular nylon bushing 104. Each nylon bushing has a central ring 106 adapted to be inserted coaxially within an upper and a lower extent of the rotator portion. The central ring of each bushing in turn has a lip 108 integrally coupled to an outer surface thereof and extended radially outward therefrom. The lip of the upper bushing is adjacent a top edge thereof and the lip of the lower bushing adjacent a bottom edge thereof. While not illustrated, the central ring and associated lip of each bushing are split into halves. Each of such halves has a pair of apertures 110 formed in ends of the associated lip for allowing the coupling thereof to corresponding threaded apertures formed in the rotator portion via a pair of unillustrated bolts. As shown in FIG. 12, an inner surface of the central ring of each bushing is tapered to emulate the taper of the flag pole. For providing even less frictional engagement between the rotator and the flag pole, the inner surface of each central ring is equipped with a plurality of spherical recesses 112 for allowing the insertion of ball bearing balls 114 therein. As shown in the pertinent Figures, portions of such bearings protrude radially inward to abut the flag pole during use. Ideally, less than 10% of the bearings protrude from the nylon thereby precluding the inadvertent removal of the bearings from the corresponding recesses. Similar to the central rings, the lips of the bushings are equipped with spherical bores 116 for allowing the insertion of a plurality of ball bearing balls 118 therein. Portions of such bearings protrude both upwardly and downwardly from the lip. By this structure, the bearings abut both the associated collar and rotator portion during use thereby providing minimal frictional engagement between the various components of the present invention. It should be noted that the spherical bores formed in the lip have arcuate side walls which have a center of curvature situated about a horizontal axis. This is to prevent the inadvertent removal of the bearings from the spherical bores.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A system for allowing a flag to freely rotate around a flagpole following the wind direction comprising, in combination:

an upper collar having two U-shaped portions, the two U-shaped portions adapted for securement around the flagpole, the two U-shaped portions tightly secured around the flagpole;

a cylindrical rotator portion having two U-shaped portions, the two U-shaped portions of the rotator portion having inner nylon surfaces, the two U-shaped portions of the rotator portion adapted for securement around the flagpole, the two U-shaped portions of the rotator portion loosely secured around the flagpole, the rotator portion disposed on the flagpole beneath the upper collar;

a lower collar having two U-shaped portions, the two U-shaped portions of the lower collar adapted for securement around the flagpole, the two U-shaped portions of the lower collar tightly secured around the flagpole, the lower collar disposed on the flagpole beneath the rotator portion; and a tie-off cleat secured to an outer surface of the rotator portion, the tie-off cleat serving for securement to a lanyard attached to the flag;

wherein the upper collar, the lower collar, and the rotator portion are fabricated of aluminum;

wherein the U-shaped portions of the rotator portion each have tabs extending radially outward from a central extent of the ends thereof, each said tab having a bore formed therein such that upon the situation of the rotator portion in operative alignment on the flagpole the bores are aligned to form a pair of bolt holes, the system further including a pair of bolts each slidably situated within one of the bolt holes, a pair of nuts screwably coupling with the bolts, and a pair of springs each situated about a corresponding bolt between the associated nut and the associated tab, a majority of a length of the bolts adjacent to heads thereof including a smooth surface on which the associated tabs and the associated spring may slide;

wherein the inner nylon surfaces each include a removable upper annular nylon bushing and a removable lower annular nylon bushing, each nylon bushing having a central ring inserted coaxially within an upper and a lower extent of the rotator portion, respectively the central ring of each said bushing having a lip integrally coupled to an outer surface thereof and extending radially outward therefrom;

wherein an inner surface of each of the central rings of the bushings are tapered to emulate a taper of the flagpole;

wherein an inner surface of each said central ring is equipped with a plurality of spherical recesses having ball bearings therein with portions of such bearings of less than 10% protruding inwardly to abut the flagpole, thereby providing minimal frictional engagement;

wherein the lips of the bushings are equipped with spherical bores having a plurality of ball bearings therein with portions of such bearings of less than 10% protruding both upwardly and downwardly from the respective lip to abut the associated collar and the rotator portion with the spherical bores of the lips of the bushings have arcuate side walls each having a center of curvature situated about a horizontal axis to prevent the ball bearings of the lips from being removed from the spherical bores of the lips of the bushings, thereby providing minimal frictional engagement.

* * * * *